US007803258B2

(12) United States Patent
Sigrist

(10) Patent No.: US 7,803,258 B2
(45) Date of Patent: Sep. 28, 2010

(54) MACHINE FOR LOCALIZED CLEANING WITH AN ELECTROLYTIC CELL, FOR PICKLING AND/OR POLISHING METAL SURFACES

(75) Inventor: Richard Sigrist, Rickenbach (CH)

(73) Assignee: EDK Research AG, Zug (CH)

( * ) Notice: Subject to any disclaimer, the term of this patent is extended or adjusted under 35 U.S.C. 154(b) by 685 days.

(21) Appl. No.: 11/454,112

(22) Filed: Jun. 16, 2006

(65) Prior Publication Data

US 2007/0062030 A1 Mar. 22, 2007

Related U.S. Application Data

(63) Continuation-in-part of application No. 10/129,472, filed as application No. PCT/IB2000/01583 on May 6, 2002.

(51) Int. Cl.
*C25D 17/14* (2006.01)

(52) U.S. Cl. ..... 204/224 R; 204/224 M; 15/321

(58) Field of Classification Search ..... 15/302, 15/321, 320; 205/604, 717
See application file for complete search history.

(56) References Cited

U.S. PATENT DOCUMENTS 2,568,803 A * 9/1951 Guenst ..... 156/345.18
3,223,610 A * 12/1965 Inoue ..... 204/224 M
3,294,664 A * 12/1966 Franklin ..... 204/224 R
3,345,672 A * 10/1967 La Mers et al. ..... 15/322
3,241,997 A 1/1969 Williams
3,443,991 A * 5/1969 Kremm ..... 134/3
3,546,088 A * 12/1970 Barkman et al. ..... 204/224 M
3,779,887 A * 12/1973 Gildone ..... 204/224 R
3,792,571 A * 2/1974 Waki et al. ..... 95/128
3,860,509 A * 1/1975 Emmett, Jr. ..... 204/281
3,902,975 A 9/1975 Martens
4,083,693 A * 4/1978 Hansen ..... 422/189
4,135,999 A * 1/1979 Schindler et al. ..... 204/418

(Continued)

FOREIGN PATENT DOCUMENTS

DE 25 16 962 * 10/1976

(Continued)

*Primary Examiner*—Frankie L Stinson
(74) *Attorney, Agent, or Firm*—Millen, White, Zelano & Branigan, P.C.

(57) ABSTRACT

A machine for localized cleaning, using pickling acid or a composition/mixture of chemical elements with the effect of pickling acid, applied by mechanical feed instruments (54, 55) to the surface to be treated (5), presenting: the acid kept in a limited quantity in the work position by a cell (1; 11); the volume of this cell (7; 17) is made to match with that of the acid used, i.e. by filling it completely with acid projected on the surface to be treated; the cell having a peripheral edge (6; 23) against the aforementioned surface; the pickling acid activated by an electrode (8; 18) that activates the acid's pickling action. A machine wherein near the cell is provided with an open collecting device for aspirating the returning air (A) and the fumes leaving the cell and the excess of pickling acid (G) that escape laterally from the cell; the open collecting device comprises a hood (12; 19) the bottom edge (20) of which surrounds the edge of the cell (1; 11); a separator (58; 59; 60; 61) is located between the cell and a fan (62) for aspirating the pickling acid and polluting fumes (G); the acid is separated from the air and fumes (F) in the aforementioned separator.

3 Claims, 3 Drawing Sheets

U.S. PATENT DOCUMENTS 4,282,626 A * 8/1981 Schneider ..... 15/320
4,620,918 A * 11/1986 Bukamier et al. ..... 204/403.02
4,627,893 A * 12/1986 Cormier et al. ..... 205/779
4,772,367 A 9/1988 Menzel
4,810,343 A * 3/1989 Bonnardel ..... 204/224 R
4,986,889 A * 1/1991 Charamathieu et al. ..... 204/279
5,028,004 A * 7/1991 Hammelmann ..... 239/120
5,135,632 A * 8/1992 Weber ..... 204/224 M
5,160,590 A 11/1992 Totsuka et al.
5,378,331 A * 1/1995 Kemp ..... 205/671
5,571,389 A * 11/1996 Kerampran ..... 204/224 R
5,603,775 A * 2/1997 Sjoberg ..... 134/21
5,964,990 A * 10/1999 Muratori et al. ..... 204/224 M
5,968,334 A * 10/1999 Li ..... 205/391
6,099,715 A 8/2000 Frembgen
7,396,430 B2 * 7/2008 Boyd et al. ..... 156/345.12
7,412,983 B2 * 8/2008 Mori ..... 134/198

FOREIGN PATENT DOCUMENTS

DE 3305967 A 8/1984
EP 436528 B 7/1991
EP 289168 A 2/1998
EP 0978577 2/2000
JP 61143600 A 1/1986
JP 62-188322 * 8/1987
JP 1-305523 * 12/1989
JP 4-206521 * 7/1992

* cited by examiner

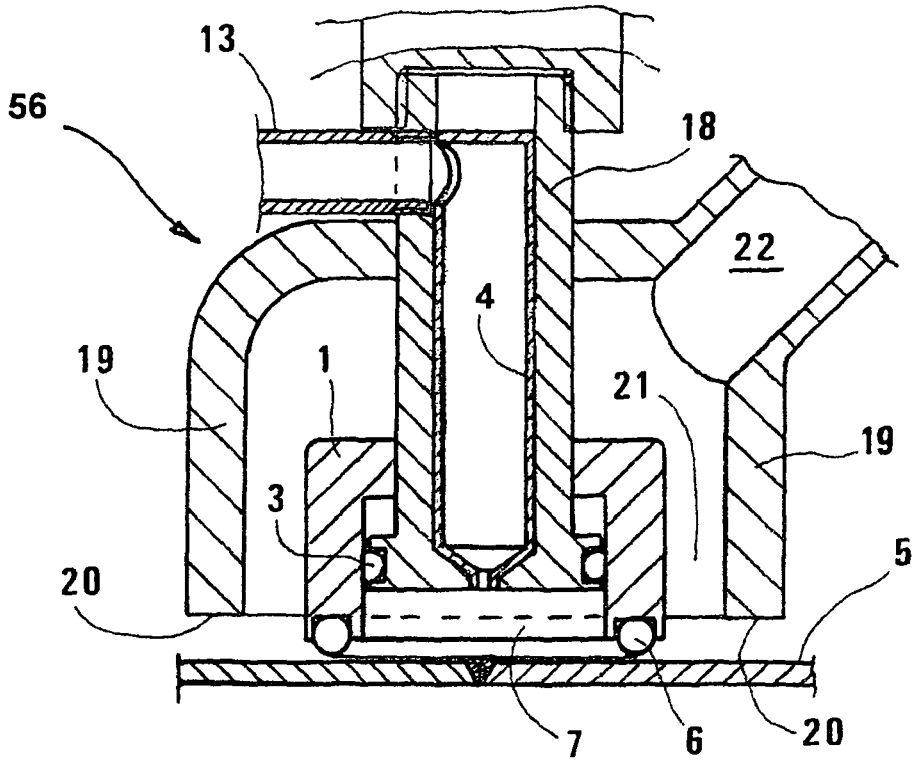
Fig. 2
Fig. 1
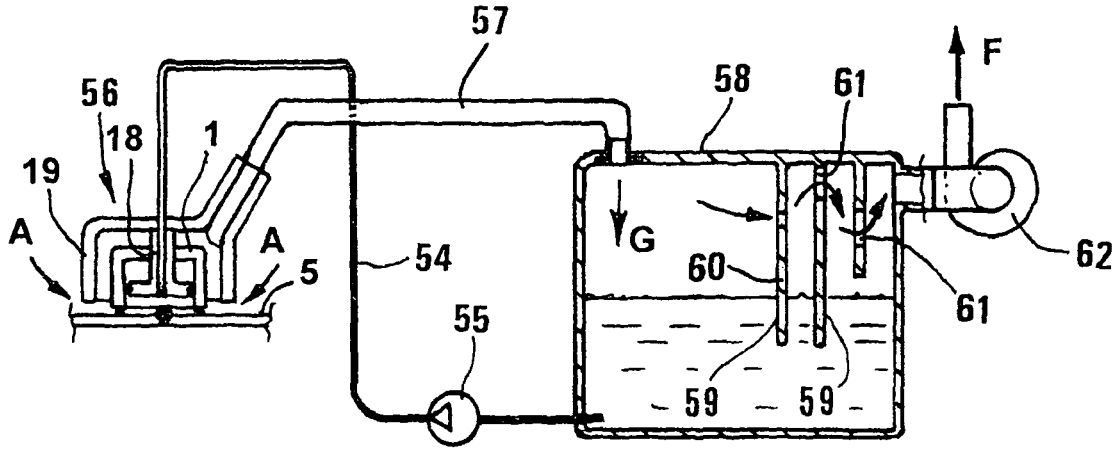

MACHINE FOR LOCALIZED CLEANING WITH AN ELECTROLYTIC CELL, FOR PICKLING AND/OR POLISHING METAL SURFACES

This application is a continuation-in-part of U.S. patent application Ser. No. 10/129,472 filed Nov. 1, 2002, which is a 371 of PCT/IB2000/01583 of Nov. 2, 2000.

TECHNICAL FIELD

The invention concerns: a machine for localised cleaning with an electrolytic cell for pickling and/or polishing, and also a machine used for cleaning metal parts on which previous processes have left scabs, halos and dirt in general on the metal surfaces; it is very useful for cleaning welding beads.

BACKGROUND ART

The prior art comprises cells that are designed for cleaning surfaces by means of pickling acid activated by electropolishing action characterized in that the metal surface to be cleaned, pickled and/or polished is treated continuously by the electropolishing action with a limited quantity of the pickling acid between the electrode and the surface; the pickling acid usually flows in and out from the cell.

European patent application EP 0 289 168 A1, to Turner et al., teaches an electroplated polishing device comprising a cell with deformable O-ring seal around its peripheral edge and ducts to let the acid flow in and out; furthermore around the edge another O-ring seal is provided to define a circular cross-section between seals connected to a vacuum pump so that the vacuum can be applied between seals for preventing the escape of pickling acid from the cell.

Furthermore, a similar prior-art device known for many years old not find practical application because of the difficulty in using the cell by hand operation, because of the impossibility of defining the working environment of the electrochemical agent without applying the vacuum or seals around the cell.

In addition, the prior art includes U.S. Pat. No. 5,135,632, to Weber, which teaches an apparatus for electropolishing surfaces comprising a circulating pump for providing the electrolyte to the surface to be treated; a cell being closed on all sides except for a side oriented towards the surface to be electropolished with an electrode for performing electropolishing; a peripheral seal attached to the rim of the inner housing (i.e., cell); an outer housing, with a peripheral seal attached to the rim of the outer housing, is provided for aspirating the rinsing fluid with a different closed circuit from the electrolyte closed circuit; the two closed circuits have relevant tank and recirculating pump each.

However, the aforementioned cell with the outer housing performs the electrpolishing with two different circuits, one for the pickling acid and the other for the rinsing fluid; the two fluids are not mixed and each of them have separation from aspirated air into its tank; thus these cell is not very useful for applying electropolishing by hand, since it is very heavy and complicated.

Moreover, the prior-art includes U.S. Pat. No. 3,443,991, to Kremm, which uses a scrubber system in a pickling process to abate the pollution of air and water and eliminate waste disposal problems; this aim is obtained by treating an hydrochloric acid solution and iron chloride by continuously reconditioning the used solution acid and regeneration of the acid solution. Kremm further teaches a scrubber having a mist remover to pick up acid and water vapours of the pickling tank. However, the liquid solution has a different circuit from the circuit of the fumes, acid, water vapour and entrained moisture particles; two scrubbers are provided one to treat the fumes, acid and water vapour and entrained moisture particles, and the other with the mist remover to treat the gases from first scrubber; the process works by exchanging warm and cool from the fluids and has exchangers for heat dissipation.

Finally, the prior-art includes the manual method of chemical cleaning the metal surfaces with pickling agents in the form of concentrated liquid acid or gel which are manually placed by the operator on the cleaning area and are left for a period of time ranging from a few minutes to several hours for the reaction to take place and then are washed off so that the entire agent is lost by being washed through the drainage point so that the workplace has to be equipped with wastewater treatment systems to prevent pollution of the external environment.

SUMMARY OF THE INVENTION

There is considerable range of improvement of the prior art by means of a device which cleans metal surfaces that is highly efficient and which has not the disadvantages of the prior art and especially which may be used by hand and does not involve cool and warm exchanges.

The foregoing remarks show that it is necessary to solve the technical problem of finding a type of electrolytic cleaning cell that ensures high pickling performance, ease of use, low consumption of pickling agent, low operating power, which the user can subject at will to heavy or light service and which efficiently prevents pollution of the workplace and of the environment.

The invention solves the aforementioned technical problem by adopting: a machine for localised cleaning, using pickling acid or a composition/mixture of chemical elements with the effect of pickling acid, applied by mechanical feed instruments to the surface to be treated; the acid is kept in a limited quantity in the working position by a cell; the volume of this cell is made to match with that of the acid used, i.e. by filling it completely with acid projected on the surface to be treated; the cell has a peripheral edge against the aforementioned surface; the pickling acid is activated by an electrode that activates the acid's pickling action; wherein near the cell is provided an open collecting device for aspirating the returning air and fumes leaving the cell and the excess of pickling acid laterally escaping from the cell; the open collecting device comprises a hood, the bottom edge of which surrounds the edge of the cell; a separator is located between the cell and a fan for aspirating the pickling acid and the polluting fumes; the acid is separated from the air and fumes in the aforementioned separator.

Adopting, in a further and preferred embodiment: the electrode may be positioned into the cell by linear movement towards the surface to be treated.

Adopting, in a further embodiment: the linear movement allows a delivery of pickling acid through the electrode.

Adopting, in a further embodiment: the linear movement acts on a valve to deliver pickling acid.

Adopting, in a further and preferred embodiment: the electrode is mounted with a bayonet connection to allow replacement of the cell.

Adopting, in a further and preferred embodiment: the edge of the cell has two opposed deflected borders.

Adopting, in a further embodiment: the hood presents vent apertures in the body of the hood.

Adopting, in a final embodiment: the hood presents vent apertures on the edge of the hood near the surface to be treated.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein:

FIG. 1 is a schematic drawing of a machine with a cell and a separator that separates the air and fumes from the electrolyte is aspirated downstream of a cleaning cell;

FIG. 2 is a schematic section drawing of cleaning cell, that fit with a hood for aspirating the air, fumes and pickling acid that escapes from the cell;

DETAILED DESCRIPTION

Figure 3:
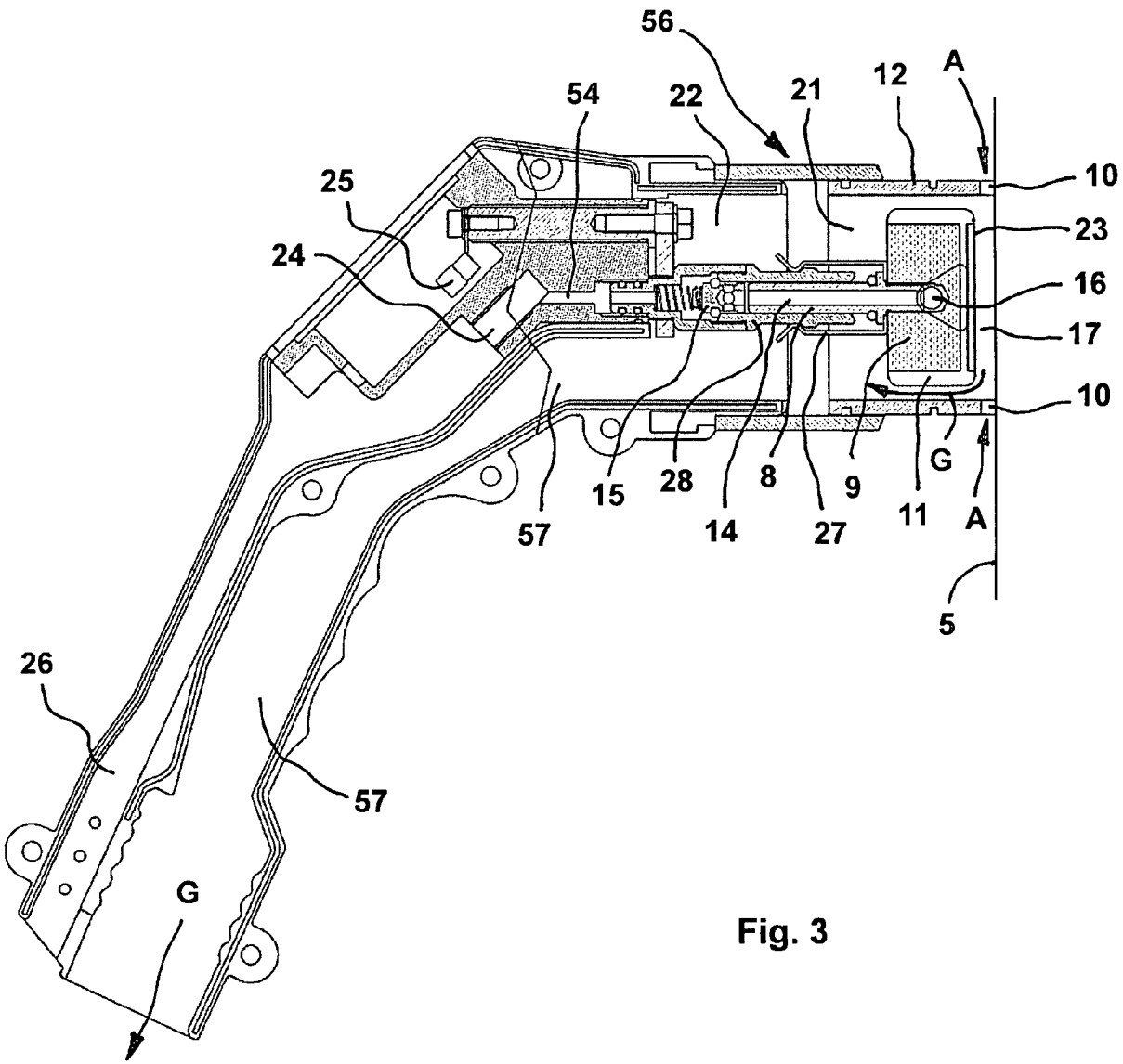
FIG. 3 is a longitudinal section drawing of an embodiment of electrolytic cleaning cell to be used by hand for performing cleaning action.

The following are shown: 54, FIG. 1, is the delivery pipe, as mechanical feed instrument, of the pickling acid, through an electrode 18, that acts as an electrolyte into a cell 1 for polishing a surface 5; 55 is the pickling acid pump; 56 is a machine with cleaning cell 1 and a hood 19 for aspirating excess of acid; A is the returning air routes for conveying G the air and the acid to the conduct 57 connected to the separator 58, which is fit with diaphragms 59 with staggered holes 60; F are the air and fumes that the fan 62 separates and pushes to a further scrubbing filter. In FIG. 2, the cell 1 is made of stiff dielectric heat-resistant material, preferably in highly resistant plastic, within which a metal or graphite electrode 18 is located with peripheral seal rings 3; 4 is a pipe inside the electrode in a material resistant to the pickling acid and acting as an electrolyte: the bottom edge of the cell that comes into contact with the surface to be treated 5 is fit with a seal ring 6 to be defined, a small volume 7 within which cleaning takes place; the pickling acid is supplied by means of the pipe 13; a bottom edge 20 of the hood 19 is near the surface to be treated 5: the air, fumes and the excess of pickling acid escaping from cell edge are aspirated by the air A sucked into the cavity 21, connected to an aspiration system by the conduct 22 between the separator 58.

Figure 4:
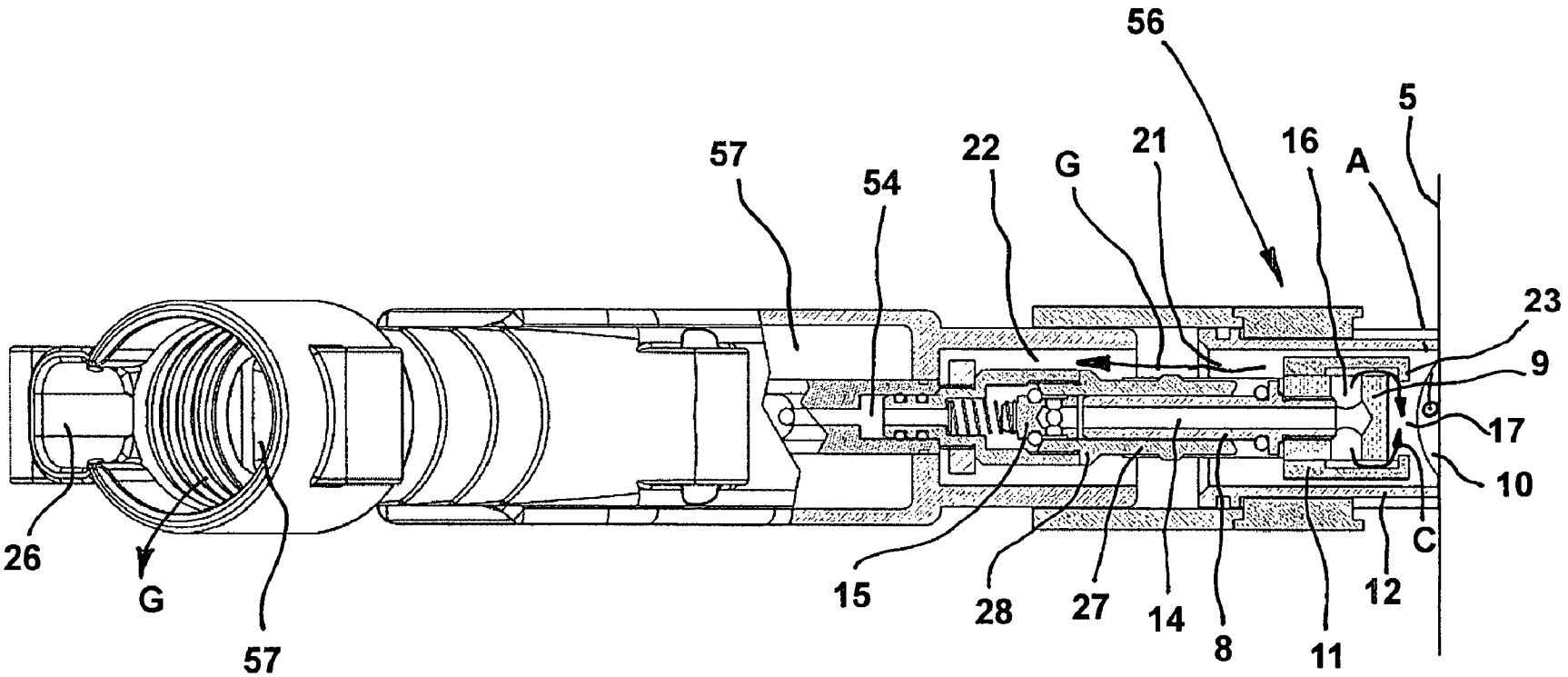
FIG. 4 is a partial schematic transverse section drawing of the cell of previous Figure to show the conformation of the hood and of the cell edge.

The following are also shown: 11, FIGS. 3 and 4, shows a cell 11 with a movable suction hood 12 around its bottom edge; 10 shows vent apertures in the edge 20 of the hood 12, near the surface to be treated; 9 is the metal or graphite body of the cell located in the cell 11 that is supplied by pickling acid to be guided in the volume 17; 14 is a pipe inside the electrode 8 connected between a valve 15 to the conduct 54 of the pickling acid; 24 is an hole to insert a pipe to deliver the acid; 25 is a terminal to connect the electric unipolar cable; 26 is a passage for the cable and the pipe for the acid (both not shown). When the cell is activated and pressed to the surface 5 the edge 23 of the cell is near to the surface and presses the valve 15 to deliver the acid through pipe 14 to a transverse duct 16 of the body of the cell 9; the acid then flows C tangentially between the body of the cell 9 and the surface 5; after the aspirated air, returning from outside the hood 12 through the vent apertures 10, the fumes generated by electropolishing and the acid are sucked G by the conduct 57 connected to the separator 58.

Localised cleaning machine works as follows. The cell is filled with pickling acid so the acid is supplied by a pump 55, which may operate intermittently or continuously, from separator 58 or from a storage tank, if an amount of acid required is lost. The acid is also an excellent electrolyte because of its electrochemical properties; the cell is then placed in contact with the surface 5 to be cleaned and cleaning is started by delivering the electrolyte the electric current. A direct or alternating electric current passes through the acid. As with the prior art, the different currents applied generate a high level of energy if the anode (+) is applied to the surface 5 and the cathode (−) is applied to the electrode 18, vice versa much less energy is obtained and this tends to polish the surface to be treated 5; thus with alternating current the effect lies between the aforementioned two. Finally, after cleaning the point, the operator moves the cell and repeats the aforementioned operations.

Moreover, it is very useful to maintain this acid supply at high levels and to collect excess pickling acid, together with the fumes generated by cleaning the surface, by means of hood 19 or 12; the recirculation of the pickling acid generated, i.e. to replace the acid overheated during operations and to give off polluting fumes and to take with it the dirt removed from the surface. The acid can be fully recirculated, thus aspiration of the fumes that have escaped from the cell through the vents located on the hollow spout is nevertheless effective.

The electrolytic treatment of the acid is enhanced by the possibility of reducing volume 7 of the cell 1, 11 to very low levels, by making the electrode 18 run along its body to the surface to be treated 5, this movement is made possible by the presence of the seal ring 3 between the aforementioned cell and the electrode 18.

The body of the cell is in stiff dielectric material that is heat resistant and preferably in highly resistant plastic while the material of the electrode is in metal or graphite and may be clad in a layer that is resistant to the action of the pickling acid in the supply conduct.

With the cell activated and pressed to the surface 5 the edge 23 of the cell 11 is near to the surface and the valve 15 delivers the acid through pipe 14 to a transverse duct 16 of the body of the cell 9; the acid then flows C tangentially between the body of the cell 9 and the surface 5, since the edge of the cell has two opposed deflected borders; after the aspirated air A, returning from outside the hood 12 through the vent apertures 10, the fumes generated by electropolishing and the acid are sucked G by the conducts 22 and 57 connected to the separator 58.

The electrode 8 is mounted with a bayonet connection 27 to the valve body 28 to allow replacement of the cell 11 as a whole.

This invention provides the following advantages: the cleaning machine is much more effective than prior-art machines since can be used by hand; a limited area of the surface to be treated is cleaned so that faces the cell volume and the cell may be moved very easing during work; the energy required to activate acid pickling is much less than that required for manual operations or for electrolytic cleaning carried out in immersion tanks; the scope of the cleaning machine is not restricted by buffer replacement or by other manual tasks such as the distribution and washing of pickling gel; the pickling acid in the cell to clean surfaces is changed by flowing in the cell volume 7, thus the cleaning capacity is greatly increased and therefore enables cleaning costs to be greatly reduced, without creating problems of pollution into the working environment.

In the practical embodiment, the details may be different from those indicated, but all technically equivalent and still fall within the scope of this invention.

The cell can therefore be made from non-insulating material but can have an insulating cladding, similarly, the edge of the electrode 18 in the cell 11 may be protected in the same way near the walls of the surface to be treated from short circuits between it and the aforementioned walls.

Furthermore, less advantageously, the vent apertures 10 of the hood 12 may be made far from the edge 20 of the hood.

Finally, much less economically, the cell material may not be resistant to corrosion from the pickling acid: the cell will have a shorter life than the cells in material resistant to acid corrosion; or the cell may be protected by a layer in material that is resistant to acid corrosion, as described above for non-insulated material.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding U.S. patent application Ser. No. 10/129,472, filed May 6, 2002, and Italian Application No. 202026/9279, filed Nov. 4, 1999, are incorporated by reference herein.

The preceding examples can be repeated with similar success by substituting the generically or specifically described reactants and/or operating conditions of this invention for those used in the preceding examples. From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A machine for localized cleaning, using pickling acid or a composition/mixture of chemical elements with the effect of pickling acid, applied by mechanical feed instruments to the surface to be treated; the acid is kept in a limited quantity in the working position by a cell; the volume of this cell having a space defining a volume is made to match with that of the acid used by filling the cell completely with acid which is projected on the surface to be treated; the cell has a peripheral edge against the aforementioned surface; the pickling acid is activated by an electrode of metal or graphite material that activates the acid's pickling action, the electrode being in proximity to the cell, wherein the pickling acid is delivered through a pipe inside the electrode; proximate the cell an open collecting device is provided that is open to ambient air for aspirating some of the ambient air as well as polluting fumes leaving the cell and excess pickling acid laterally escaping from the cell; the open collecting device comprises a hood, the bottom edge of which surrounds the edge of the cell; a separator is located between the cell and a fan for aspirating the pickling acid and the polluting fumes, the acid being separated from the air and the polluting fumes in the separator; moreover, the hood has linear movement with respect to the cell by linear movement towards the surface to be treated; furthermore, the electrode is positioned within the cell by linear movement with respect to the surface to be treated; the cell has a metal or graphite body and two opposed deflected borders; moreover, the electrode is mounted with a bayonet connection to allow replacement of the cell as a whole; furthermore, the assembly is mounted on a handle; wherein the hood has vent apertures on the edge of the hood near the surface to be treated; furthermore, the separator is connected to the collecting device by a conduit that conveys the polluting fumes and excess acid entrained in the ambient area to the separator, whereby the cell, electrode and collecting device form an assembly that is operable at a distance from the separator.

2. A machine for localized cleaning according to claim 1, characterised in that the air and fumes, generated during the pickling action, are further treated in a scrubbing filter.

3. A machine for localized cleaning, using pickling acid or a composition/mixture of chemical elements with the effect of pickling acid, applied by mechanical feed instruments to the surface to be treated; the acid is kept in a limited quantity in the working position by a cell; the volume of this cell having a space defining a volume is made to match with that of the acid used by filling the cell completely with acid which is projected on the surface to be treated; the cell has a peripheral edge against the aforementioned surface; the pickling acid is activated by an electrode of metal or graphite material that activates the acid's pickling action, the electrode being in proximity to the cell, wherein the pickling acid is delivered through a pipe inside the electrode; proximate the cell an open collecting device is provided that is open to ambient air for aspirating some of the ambient air as well as polluting fumes leaving the cell and excess pickling acid laterally escaping from the cell; the open collecting device comprises a hood, the bottom edge of which surrounds the edge of the cell; a separator is located between the cell and a fan for aspirating the pickling acid and the polluting fumes, the acid being separated from the air and the polluting fumes in the separator; moreover, the hood has linear movement with respect to the cell by linear movement towards the surface to be treated; furthermore, the electrode is positioned within the cell by linear movement with respect to the surface to be treated; the cell has a metal or graphite body and two opposed deflected borders; moreover, the electrode is mounted with a bayonet connection to allow replacement of the cell as a whole; furthermore, the assembly is mounted on a handle; wherein the hood has vent apertures on the edge of the hood near the surface to be treated; furthermore, the separator is connected to the collecting device by a conduit that conveys the polluting fumes and excess acid entrained in the ambient area to the separator, whereby the cell, electrode and collecting device form an assembly that is operable at a distance from the separator; the air and fumes, generated during the pickling action, are further treated in a scrubbing filter.

* * * * *